US005894734A

United States Patent [19]

Morishita et al.

[11] Patent Number: 5,894,734

[45] Date of Patent: Apr. 20, 1999

[54] WATER-CIRCULATING TYPE ICE MAKER

[75] Inventors: Takashi Morishita; Masahide Yatori, both of Aichi-ken, Japan

[73] Assignee: Hoshizaki Denki Kabushiki Kaisha, Toyoake, Japan

[21] Appl. No.: 08/967,060

[22] Filed: Nov. 10, 1997

[51] Int. Cl.[6] ..... F25C 1/12

[52] U.S. Cl. ..... 62/135; 62/228.2

[58] Field of Search ..... 62/135, 137, 138, 62/228.2, 228.3

[56] References Cited

U.S. PATENT DOCUMENTS

| | | | |
|---|---|---|---|
| 4,357,807 | 11/1982 | Aleksandrow | 62/228.2 |
| 4,884,413 | 12/1989 | Quandt et al. | 62/135 |
| 4,938,030 | 7/1990 | Josten et al. | 62/138 |
| 4,959,966 | 10/1990 | Dimijian | 62/138 |
| 5,653,114 | 8/1997 | Newman et al. | 62/347 |

*Primary Examiner*—William E. Tapoical
*Attorney, Agent, or Firm*—Wenderoth, Lind & Ponack, L.L.P.

[57] ABSTRACT

A water-circulating type ice maker of the present invention comprises a refrigerating capacity detecting means for detecting the refrigerating capacity of the ice maker at a set temperature, which is slightly above the temperature where the ice-making water starts to freeze in the state of partial ice, and an ice-making plate temperature lowering means for lowering the temperature of the ice-making plate as a counter measure against partial ice generation so that the ice-making plate temperature lowering means starts operating when the refrigerating capacity detected by the refrigerating capacity detecting means is lower than a predetermined capacity. The comparison of the refrigerating capacity detected by the refrigerating capacity detecting means and the predetermined capacity can be made by detecting the high side pressure, the low side pressure, the condensing temperature or the evaporating temperature when the ice-making water reaches the set temperature. Furthermore, the ice-making plate temperature lowering means can be one that, for example, stops the ice-making water circulation pump.

14 Claims, 4 Drawing Sheets

WATER-CIRCULATING TYPE ICE MAKER

BACKGROUND OF THE INVENTION

1. Field of the Invention

The present invention relates to a water-circulating type ice maker having a refrigerating circuit comprising an ice-making water circuit where ice-making water is circulated and supplied to an ice-making plate by a circulating pump, an evaporator provided at the ice-making plate for freezing the circulating water on the ice-making plate, and a condenser which is cooled by the air surrounding the ice maker or a cooling medium such as cooling water; in particular, the present invention relates to a device capable of preventing the phenomenon of generating cotton-like or slushy partial ice, which are characteristic of this type of an ice maker, (hereinafter referred to as partial ice) immediately before freezing.

2. Description of the Related Art

A water-circulating type ice maker is an ice-maker for producing pure ice where the impurities are eliminated at the surface of the ice-making plate by repeating the process of flowing ice-making water on the surface of the ice-making plate during the freezing cycle. Various kinds of ice makers having different types of ice-making plates such as a vertical flat-plate type, a vertical pipe type, and a spray type are known. When freezing ice-making water, however, all of these water-circulating type ice makers have a common problem: cotton-like or a slushy ice is generated before freezing begins because the freezing temperature of the ice-making water becomes 0° Celsius or less.

The type of ice generated depends upon the flow rate, plate surface temperature, etc. Among the above-mentioned examples, in the case of the spray type ice maker, which has the highest flow rate and a low plate surface temperature, cotton-like ice develops momentarily in the water-gathering pan or the water tank into which unfrozen water falls. Further, in the case of the vertical flat-plate type ice maker which has the lowest flow rate and a high plate surface temperature, slushy ice may develop partially on the ice-making plate to disturb the circulation of the water.

Various methods are conventionally known to prevent the generation of the partial ice, such as slushy or cotton-like ice. For example, Japanese Patent Application Laid-open No. 58-15706 discloses a technique for preventing generation of partial ice by predicting the generation of partial ice when the ice-making water reaches a predetermined temperature and temporarily stopping the supply of ice-making water from the ice-making water tank to the ice-making plate so as to either supercool the ice-making plate or form an initial ice film, and then resuming the operation of the ice-making water circulating pump.

Furthermore, Japanese Patent Application Laid-open No. 6-21753 discloses a technique for preventing generation of partial ice (cotton-like ice) by predicting the generation of partial ice when the ice-making water reaches a predetermined temperature and temporarily closing a solenoid valve or the expansion valve in the refrigerating circuit of the ice maker so as to rapidly lower the temperature of the ice-making plate to form the ice core necessary for ordinary ice growth on the ice-making plate.

Although both of the above-mentioned methods can prevent the generation of partial ice, they have the following problems.

For example, in the case of the former method of stopping the ice-making water circulating pump, since the refrigerating load becomes essentially zero with a long stop time, the liquid refrigerant returns from the evaporator to the compressor without evaporating and there is a risk of liquid compression in the compressor. However, the length of the stop time required to generate liquid compression in the compressor varies depending upon the temperature of the ice-making water at the time of the stoppage, the size of the refrigerating capacity with respect to the freezing load, etc.

When the former technique is applied in an ice maker having a harvesting water tank, the cooled and circulated ice-making water returns to the ice-making water tank during the stoppage of the ice-making water circulating pump without making ice so that the amount of water in the ice-making water tank increases. Then, since any cooled ice-making overflow water flows down into the harvesting water tank, energy is wasted. Furthermore, since the temperature of the harvesting water in the harvesting water tank is lowered due to the overflow water, the harvesting time is prolonged, and the problem of decreased ice-making capacity occurs.

In the case of the latter technique of opening the solenoid valve or the expansion valve, since the ice-making water circulating pump is not temporarily stopped, the above-mentioned problem of the former technique can be solved. However, since the refrigerant is not supplied from the compressor to the evaporator and the refrigerant left in the evaporator is sucked by the compressor, a long stop time involves the risk of stopping the operation of the ice maker due to the low pressure of the refrigerating circuit so that the low pressure switch functions to stop the compressor. The length of stopping time required to cause the operation of the ice maker to halt varies depending upon the temperature of the ice-making water at the time of the stoppage, the size of the refrigerating capacity with respect to the freezing load, etc.

The mechanism of partial ice generation has not been completely clarified. However, according to the knowledge and experience of the inventors, it is understood that when the refrigerating capacity is smaller than the refrigerating capacity necessary to cool and freeze the ice-making water, that is, the refrigerating load for making ice when the temperature is slightly above the temperature where the ice-making water starts freezing, partial ice is generated. On the other hand, when the refrigerating capacity is sufficiently large with respect to the refrigerating load for making ice, partial ice is not generated.

The size relationship between the refrigerating capacity of the ice maker and the refrigerating load for making ice varies depending upon the number of times the freezing cycle has been repeated since starting operation of the ice maker. For example, when operation of the ice maker is resumed after a long stoppage, the temperature of the components comprising the ice maker are high in the initial freezing cycle. Further, the refrigerating load for making ice can be roughly divided into the refrigerating heat quantity needed for cooling the ice-making water and the refrigerating heat quantity needed for cooling elements excluding the ice-making water, such as the components comprising the ice-making water circulation path. Therefore, in the initial freezing cycle, the refrigerating heat quantity needed for cooling the elements excluding the ice-making water is large. Accordingly, the refrigerating capacity is small with respect to the refrigerating load for making ice and it can be said that partial ice can be generated easily.

The relationship between the refrigerating capacity of the ice maker and the refrigerating load for making ice also varies depending upon the surrounding air temperature. For example, the higher the surrounding air temperature, the smaller the refrigerating capacity of the ice maker becomes. Accordingly, the refrigerating capacity easily becomes small with respect to the refrigerating load for making ice, and partial ice can be generated easily.

The relationship between the refrigerating capacity of the ice maker and the refrigerating load for making ice also varies depending upon the frequency level of the power source of the ice maker. For example, when an ice maker compatible with both a 60 Hz power source and a 50 Hz power source is used with the 50 Hz power source, the refrigerating capacity of the ice maker becomes smaller than when it is used with the 60 Hz power source. Therefore, the refrigerating capacity easily becomes small with respect to the refrigerating load for making ice, and thus the partial ice can be generated easily.

Furthermore, as mentioned above, generation of partial ice depends upon the size of the refrigerating load for making ice with respect to the refrigerating capacity of the ice maker. This relationship is particularly important when the ice-making water changes state to ice.

More specifically, since 80 kcal of latent heat is necessary per 1 kg of water for a state change of the ice-making water to ice, a maximum refrigerating capacity is required at the time of this state change. The state change is denoted as the maximum load point. If the refrigerating capacity for cooling the ice-making water is insufficient at the maximum load point, the cooling rate of the ice-making water becomes slow so that the time to pass through the maximum load point increases, and the generation of partial ice becomes likely.

According to the above-mentioned partial ice generation mechanism, partial ice is not always generated when ice-making water reaches a certain temperature, but is generated when the refrigerating capacity is small with respect to the freezing load when the ice-making water reaches the certain temperature.

However, conventional techniques always dealt with measures for preventing the generation of partial ice only when the ice-making water reaches a predetermined set temperature. Therefore, the conventional techniques facilitated the above-mentioned accompanying problems when the counter measures for partial ice generation were not necessary.

As mentioned above, in general, both the refrigerating capacity of the ice maker and the refrigerating load for making ice vary according to the operating conditions. Furthermore, the refrigerating capacity of the ice maker can be theoretically calculated from the cooling heat source such as the external air, and from the temperature of the ice-making water. On the other hand, the refrigerating load for making ice includes the refrigerating heat quantity for freezing the ice-making water and the refrigerating heat quantity for cooling the elements excluding the ice-making water. Among the heat quantities, the former can be calculated theoretically. However, it is difficult to calculate the latter theoretically, and it can only be estimated based on the value obtained from experience or experiment. Thus, it may drastically vary according to the operating conditions. Therefore, it is considered difficult to predict the refrigerating load for making ice, and to determine whether or not the refrigerating capacity of the ice maker is insufficient with respect to the predicted refrigerating load.

SUMMARY OF THE INVENTION

An object of the present invention is to minimize the problems accompanying the counter measures for partial ice generation such as liquid compression in the compressor, wasteful consumption of energy, halted operations caused by the low pressure switch function, prolonged harvesting time, etc. by implementing the counter measures for partial ice generation only when necessary.

Another object of the present invention is to make it easy to determine whether or not a counter measure for partial ice generation is needed.

Still another object of the present invention is to make possible a more accurate determination of whether or not a counter measure for partial ice generation is needed.

A preferred embodiment of a water-circulating type ice maker of the present invention comprises; a refrigerating circuit having an ice-making water circuit where ice-making water is circulated and supplied to an ice-making plate by a circulation pump, an evaporator provided of the ice-making plate for freezing the circulating water on the ice-making plate, and a condenser to be cooled by the air surrounding the ice maker or by a cooling medium such as cooling water, wherein a refrigerating capacity detecting means for detecting the refrigerating capacity of the ice maker at a set temperature, which is slightly above the temperature where the ice-making water starts freezing in the state of partial ice, and an ice-making plate temperature lowering means for lowering the temperature of the ice-making plate as a counter measure for partial ice generation are provided so that the ice-making plate temperature lowering means starts operating when the refrigerating capacity detected by the refrigerating capacity detecting means is less than a predetermined capacity.

In the above-mentioned embodiment, predetermined capacity refers to the refrigerating capacity expended in making ice when the ice-making water temperature is at a set temperature, that is, the refrigerating load for making ice when the ice-making water temperature is at the set temperature. The same definition applies hereinafter.

Accordingly, the predetermined capacity can be predicted in certain conditions where the operating conditions are comparatively stable. In general, when the refrigerating heat quantity for cooling the elements excluding the ice-making water, which can drastically fluctuate according to the operating conditions, are kept within a certain heat quantity range, the refrigerating heat quantity fluctuation within this set range can be predicted.

Further, in the water-circulating type ice maker of the above-mentioned configuration, since the set temperature is set at a temperature slightly above the temperature where the ice-making water starts freezing in the state of partial ice, by comparing refrigerating load for making ice and the refrigerating capacity, the conditions become optimum for obtaining a judgment of whether or not partial ice will be generated.

Furthermore, since the counter measure for partial ice generation functions only when the refrigerating capacity is not more than the predetermined capacity, that is, only when there is a fear that partial ice will be generated, the conventional problems, namely, liquid compression in the compressor, wasteful energy loss, halted operations, etc., can be kept to a minimum.

In a refrigerating device of an ice maker, since the high side pressure, the condensing temperature, the low side pressure and the evaporating temperature become higher when the refrigerating capacity is small with respect to the refrigerating load, and on the other hand, the high side pressure, the condensing temperature, the low side pressure and the evaporating temperature become lower when the refrigerating capacity is large with respect to the refrigerating load, it can be indirectly determine whether the refrigerating capacity detected by the refrigerating capacity detecting means is large or small with respect to the predetermined capacity by detecting a certain high side pressure, condensing temperature, low side pressure, and evaporating temperature and comparing the detected values with preliminarily set standard values.

Another preferred embodiment of a water-circulating type ice maker of the present invention comprises a refrigerating circuit having an ice-making water circuit where ice-making water is circulated and supplied to an ice-making plate by a circulation pump, an evaporator provided at the ice-making plate for freezing the circulating water on the ice-making plate, and a condenser to be cooled by the air surrounding the ice maker or by a cooling medium such as cooling water, wherein a refrigerating capacity detecting means for detecting the refrigerating capacity of the ice maker at a set temperature, which is slightly above the temperature where the ice-making water starts freezing in the state of partial ice, and an ice-making plate temperature lowering means for lowering the temperature of the ice-making plate as a counter measure for partial ice generation are provided so that the ice-making plate temperature lowering means starts operating whenever the ice-making water temperature reaches the set temperature in the initial freezing cycle after starting the ice-maker, and the ice-making plate temperature lowering means starts operating when the refrigerating capacity detected by the refrigerating capacity detecting means is less than a predetermined capacity in the second or subsequent freezing cycles.

Since components of the device are not yet sufficiently cooled in the initial freezing cycle after starting the ice maker, the refrigerating load for making ice is large and thus partial ice is easily generated. Moreover, the difference. between the predetermined capacity and the actual refrigerating load for making ice tends to be large. However, according to this embodiment, since the ice-making plate temperature lowering means always starts operating when the ice-making water reaches the set temperature in the initial freezing cycle after starting the ice maker, partial ice generation in the initial freezing cycle can be prevented. Furthermore, since the refrigerating capacity at the set temperature of the ice-making water is detected and the ice-making plate temperature lowering means starts operating only when the refrigerating capacity is less than the predetermined capacity in the second or subsequent cycles as in the first embodiment, the counter measure for partial ice generation is implemented only when necessary, so the accompanying problems such as liquid compression, wasteful energy loss, and halted operations can be kept to a minimum. Furthermore, since the temperature changes in the device are smaller in the second or subsequent cycles and the difference between the predetermined capacity and the actual refrigerating load for making ice can be made smaller, a more accurate determination of whether or not the counter measure for partial ice generation is necessary can be made.

According to yet another preferred embodiment of the water-circulating type ice maker, the refrigerating capacity detecting means is provided such that after detecting the high side pressure a determination is made that the refrigerating capacity is lower than the predetermined capacity when the high side pressure is greater than the standard high side pressure, and that the refrigerating capacity is greater than the predetermined capacity when the high side pressure is lower than the standard high side pressure.

According to yet another preferred embodiment of the water-circulating type ice maker, the refrigerating capacity detecting means is provided such that after detecting the condensing temperature a determination is made that the refrigerating capacity is lower than the predetermined capacity when the condensing temperature is greater than the standard condensing temperature and that the refrigerating capacity is greater than the predetermined capacity when the condensing temperature is lower than the standard condensing temperature.

According to yet another preferred embodiment of the water-circulating type ice maker, the refrigerating capacity detecting means is provided such that after detecting the low side pressure a determination is made that the refrigerating capacity is lower than the predetermined capacity when the low side pressure is greater than the standard low side pressure and that the refrigerating capacity is greater than the predetermined capacity when the low side pressure is lower than the standard low side pressure.

According to yet another preferred embodiment of the water-circulating type ice maker, the refrigerating capacity detecting means is provided such that after detecting the evaporating temperature a determination is made that the refrigerating capacity is lower than the predetermined capacity when the evaporating temperature is greater than the standard evaporating temperature and that the refrigerating capacity is greater than the predetermined capacity when the evaporating temperature is lower than the standard evaporating temperature.

According to yet another preferred embodiment of the water-circulating type ice maker, the refrigerating capacity detecting means is provided such that after detecting the difference between the ice-making water temperature and the evaporating temperature a determination is made that the refrigerating capacity is lower than the predetermined capacity when the temperature difference is lower than the standard temperature difference and that the refrigerating capacity is greater than the predetermined capacity when the temperature difference is greater than the standard temperature difference.

According to yet another preferred embodiment of the water-circulating type ice maker, the refrigerating capacity detecting means is provided such that after detecting the temperature of the refrigerant in the condenser a determination is made that the refrigerating capacity is lower than the predetermined capacity when the refrigerant temperature is greater than the standard refrigerant temperature and that the refrigerating capacity is greater than the predetermined capacity when the refrigerant temperature is lower than the standard refrigerant temperature.

BRIEF DESCRIPTION OF THE DRAWINGS

Further objects and advantages of the present invention will be described in more detail in conjunction with the accompanying drawings.

DESCRIPTION OF THE PREFERRED EMBODIMENTS

Hereinafter embodiments of the present invention applied to a water-circulating type ice maker will be explained in detail with reference to accompanying drawings.

Figure 1:
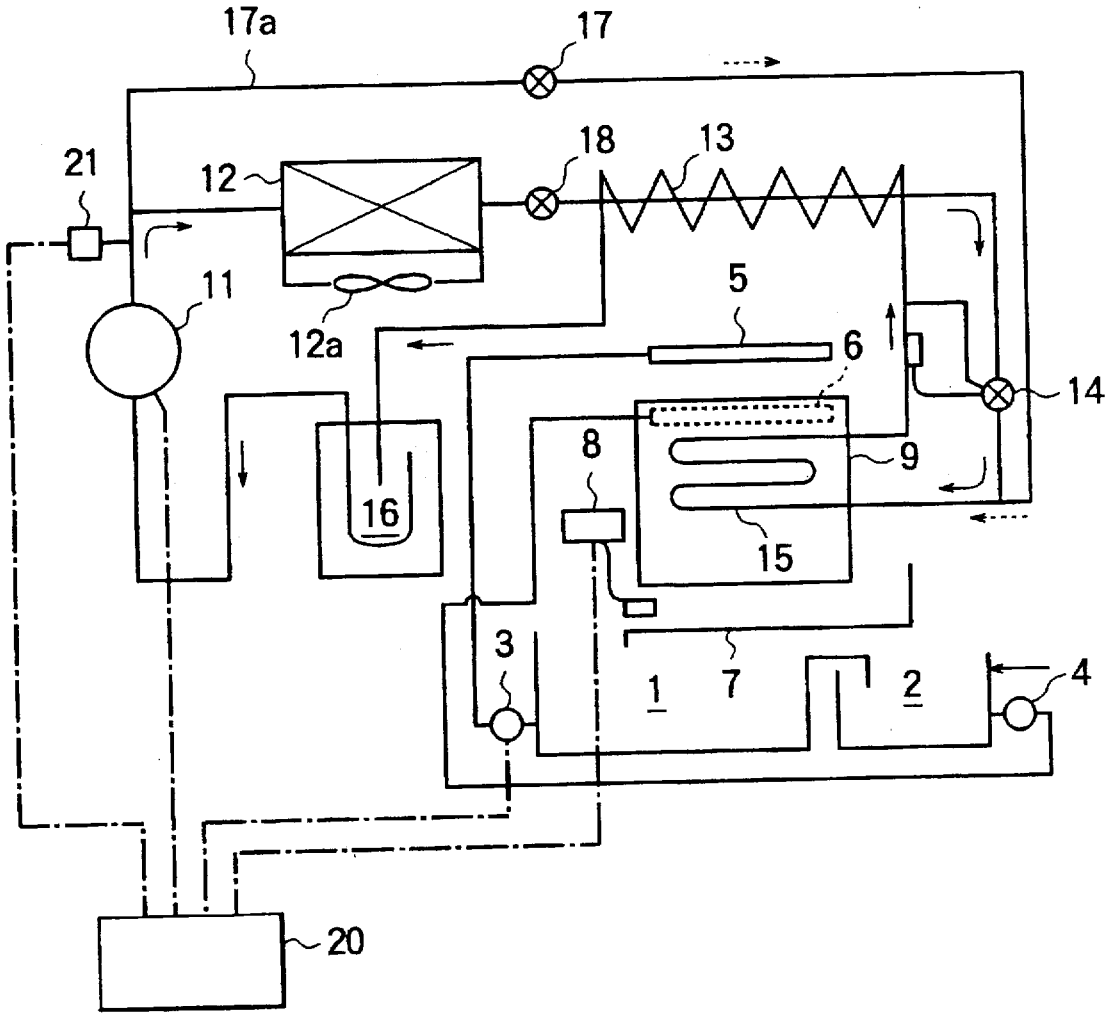
FIG. 1 is a schematic diagram of an embodiment of an ice maker of the present invention.

FIG. 1 is a schematic diagram showing an embodiment of a water-circulating type ice maker of the present invention. An ice-making water circuit of the ice maker comprises an ice-making water tank 1, an ice-making water circulation pump 3 for circulating ice-making water stored in the ice-making water tank 1 in the ice-making water circuit, a distributor 5, connected to the ice-making water circulation pump 3, to be supplied with the ice-making water, an ice-making plate 9, and a water-gathering pan 7 for receiving the ice-making water that falls from the ice-making plate 9 and returning it to the ice-making water tank 1.

A harvesting water circuit comprises a harvesting water tank 2, a harvesting water circulation pump 4 connected to the harvesting water tank 2, and a distributor 6, wherein the water-gathering pan 7 and the ice-making water tank 1 are shared by the ice-making water circuit such that the water distributed from the distributor 6 is received by the water-gathering pan 7 and returned to the ice-making water tank 1.

The ice-making plate 9 is a vertical type ice-making plate the rear side of which is provided with an evaporator 15 that comprises part of a refrigerating circuit described later, that is provided in a heat exchanging relationship with the ice-making plate 9 and in a zigzag fashion. The ice-making plate 9 may be a spray type ice-making compartment where ice-making water is sprayed into a plurality of small ice-making compartment, such ice-making compartment is also being referred to herein as an ice-making plate. Ice-making water is supplied and distributed to the ice-making plate 9 during an freezing cycle by the ice-making water circulation pump 3, and harvesting water is supplied and distributed thereto during a harvesting cycle by the harvesting water circulation pump 4.

A temperature sensor 8 for detecting the temperature of the ice-making water flowing from the ice-making plate 9 to the ice-making water tank 1 is provided in the water-gathering pan 7. The temperature sensor 8 may be mounted anywhere as long as the temperature of the ice-making water during circulation can be accurately detected, such as at the inlet of the distributor 5, inside the water-gathering pan 7, and inside the ice-making water tank 1. When the temperature sensor 8 is arranged inside the ice-making water tank 1, it is preferable to have it in a position where the temperature of the water falling from the water-gathering pan 7 can be detected.

In addition to the above-mentioned evaporator 15, the refrigerating circuit of the ice maker further comprises: a compressor 11; a condenser 12 provided with a fan **12*a*; a solenoid valve 18 provided in the liquid pipe; a heat exchanger 13; and an expansion valve 14; an accumulator.16; a hot gas bypass solenoid valve 17; and a high pressure sensor 21**.

The solenoid valve 17 is provided inside a hot gas bypass pipe **17*a* which connects the outlet of the condenser 11 with the inlet of the evaporator 15 so as to bypass the condenser 12, the solenoid valve 18, the heat exchanger 13 and the expansion valve 14**.

As mentioned above, the present invention is based on the knowledge and experience of the inventors that when a refrigerating capacity detected at a set temperature slightly above the temperature where the ice-making water starts freezing in the state of partial ice is lower than a predetermined capacity, partial ice develops, and when the refrigerating capacity is greater than the predetermined capacity, partial ice does not develop. That is, it is based on the idea that if the refrigerating capacity is small with respect to the refrigerating load for making ice at the maximum load point where the ice-making water change state to ice, the temperature of the ice-making plate 9 does not decease, time is required to pass the maximum load point, and thus partial ice is more likely to develop.

Accordingly, in the present invention, the ice-making plate temperature lowering means for rapidly lowering the temperature of the ice-making plate 9 functions at the maximum load point only when the refrigerating capacity is small with respect to the refrigerating load for making ice. Further, by the functioning of the ice-making plate temperature lowering means, the temperature of the ice-making plate 9 is lowered instantly so that the ice-making water in the vicinity of the ice-making plate 9 is temporarily supercooled to freeze. According to experimented results, when the temperature of the ice-making plate 9 is lowered from −5 C. to −10 C. by operating the ice-making plate temperature lowering means, the ice-making water in the vicinity of the ice-making plate 9 can be supercooled to freeze in about 15 seconds. Then, after resuming ordinary ice-making operation, the ice-making process is facilitated by having the ice as a core to prevent generation of partial ice.

In this embodiment, the refrigerating capacity detecting means is provided such that the temperature of the ice-making water is detected by the temperature sensor 8, the high side pressure, such as the discharged gas pressure and the condensing pressure, in the refrigerating circuit is detected by the high pressure sensor 21 such as a high pressure controller. When the temperature of the ice-making water reaches the set temperature, the controlling device 20 compares the detected high side pressure with a standard high side pressure preliminarily recorded in the memory of the controlling device 20, and a determination is made that the refrigerating capacity is lower than the predetermined capacity when the detected high side pressure is higher than the standard high side pressure, or that the refrigerating capacity is greater than the predetermined capacity when the detected high side pressure is lower than the standard high side pressure. From an experimental or empirical view point the set temperature is determined to be about 1° C.

Figure 2:
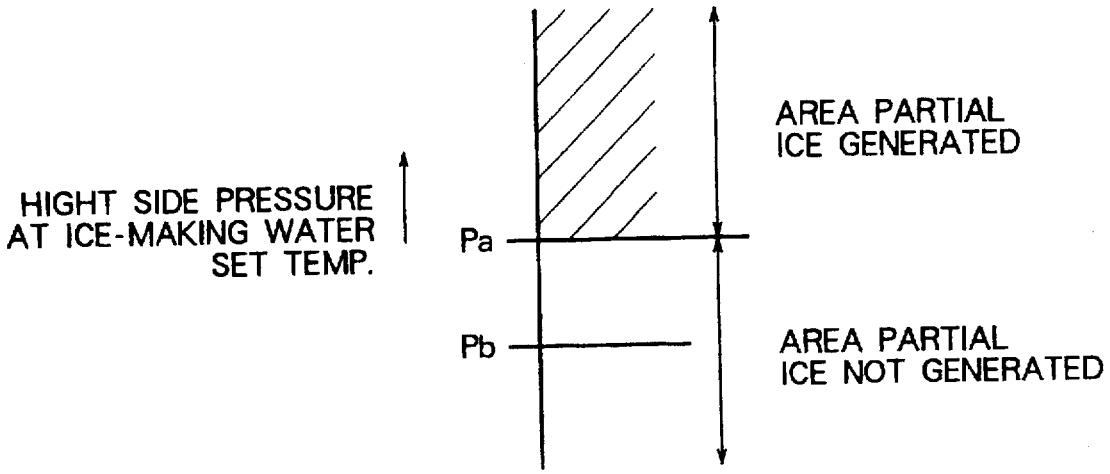
FIG. 2 is a diagram showing the relationship between high side pressure and partial ice generation.

FIG. 2 shows how to make this determination. The high side pressure at the set temperature of the ice-making water is plotted in the vertical axis. With a high side pressure of Pa or higher, a partial ice is generated and with a high side pressure of lower than Pa, partial ice is not generated. A standard high side pressure value Pb is set in the area where partial ice is not generated as the standard high side pressure for determination the refrigerating capacity.

The ice-making plate temperature lowering means for lowering the temperature of the ice-making plate 9 as the counter measure for partial ice generation is provided such that the ice-making water circulation pump 3 for sending the ice-making water to the distributor 5 is temporarily stopped by a command from the controlling device 20 when the refrigerating capacity is determined to be lower than the predetermined capacity. That is, when the refrigerating capacity is determined to be less than the predetermined freezing load for making ice.

Next the function of this embodiment will be explained.

Operation of the ice-maker is started by turning on an operation switch (not illustrated) or by the operation of a sensor (not illustrated) which starts the operation when the amount of ice in the ice bin (not illustrated) is small.

Once the operation of the ice maker starts, the freezing cycle and the harvesting cycle are continued alternately until the amount of the ice in the ice bin reaches a predetermined amount, unless the process is interrupted intentionally.

The initial freezing cycle refers to the first freezing cycle after resuming the operation of the ice maker from a stopped condition.

The freezing cycles, including both the initial freezing cycle and the second or subsequent freezing cycles, are set so as to be able to start operating after a certain passage of time from the beginning of the previous harvest cycle. Operation is also possible when the temperature of the gas sucked in by the compressor is greater than a predetermined temperature instead of the detection of a certain time.

The ice-making water circulation pump 3 is started in the freezing cycle so that the ice-making water enters the distributor 5 via the pipe path from the ice-making water tank 1, is distributed from the distributing holes of the distributor 5 to the surface of the ice-making plate 9, and returns to the ice-making water tank 1. In the refrigerating circuit, the refrigerant flows in the direction of the solid arrow in FIG. 1 when the solenoid valve 17 of the hot gas bypass pipe 17*a* is closed, the solenoid valve 18 provided. in the liquid pipe is opened, and the compressor 11 is driven. That is, the refrigerant discharged from the compressor 11 flows through the condenser 12, the solenoid valve 18, the heat exchanger 13, the expansion valve 14, and the evaporator 15 which is provided in a heat exchanging relationship with the ice-making plate 9, and cools the ice-making plate 9. Then the refrigerant flows through the heat exchanger 13 and the accumulator 16 to return to the compressor 11. Therefore, the ice-making water circulating as mentioned above is cooled when flowing through the ice-making plate 9 so as to be gradually frozen.

In the freezing cycle, when the ice-making water temperature reaches the set temperature, for example, 1° C., the high side pressure is detected by the high pressure sensor 21. When the high side pressure is lower than the standard high side pressure Pb, the refrigerating capacity is determined to be greater than the predetermined capacity so that the freezing cycle continues until the water level of the ice-making water tank 1 is lowered to a certain level. However, when the high side pressure is greater than the standard high side pressure Pb, the refrigerating capacity is determined to be lower than the predetermined capacity so that the ice-making plate temperature lowering means starts operating the ice-making water circulation pump 3 is temporarily stopped, and the ice-making plate 9 is rapidly cooled. As a result, the ice-making plate 9 is instantly frozen. In the subsequent ordinary freezing cycle, the ice-making process is facilitated by an ice core. The ordinary freezing cycle continues until the water level of the ice-making water tank 1 is lowered to a predetermined level. Accordingly, the generation of partial ice in the freezing cycle can be prevented.

The harvest cycle starts when the water level of the ice-making water tank 1 is lowered to a predetermined level so that the freezing cycle is stopped. In the harvest cycle, the harvesting water circulation pump 4 starts operating such that the harvesting water is sent from the harvesting water tank 2 to the distributor 6 via the pipe path, is distributed from the distributing holes of the distributor 6 at the rear side of the ice-making plate 9 and enters the ice-making water tank 1 via a path such as the water-gathering pan 7. At the same time, the solenoid valve 17 of the hot gas bypass pipe 17*a* is opened such that the hot gas is supplied to the evaporator 15 as shown by the doted arrows in FIG. 1 so as to remove ice adhered to the surface of the ice-making plate 9. The ice-making water tank 1 is filled with the harvesting water.

By alternate repetition of the harvest cycle and the freezing cycle as mentioned above, ice is stored in the ice bin (not illustrated) and the operation of the ice maker is stopped when the ice bin is filled with ice.

Figure 4:
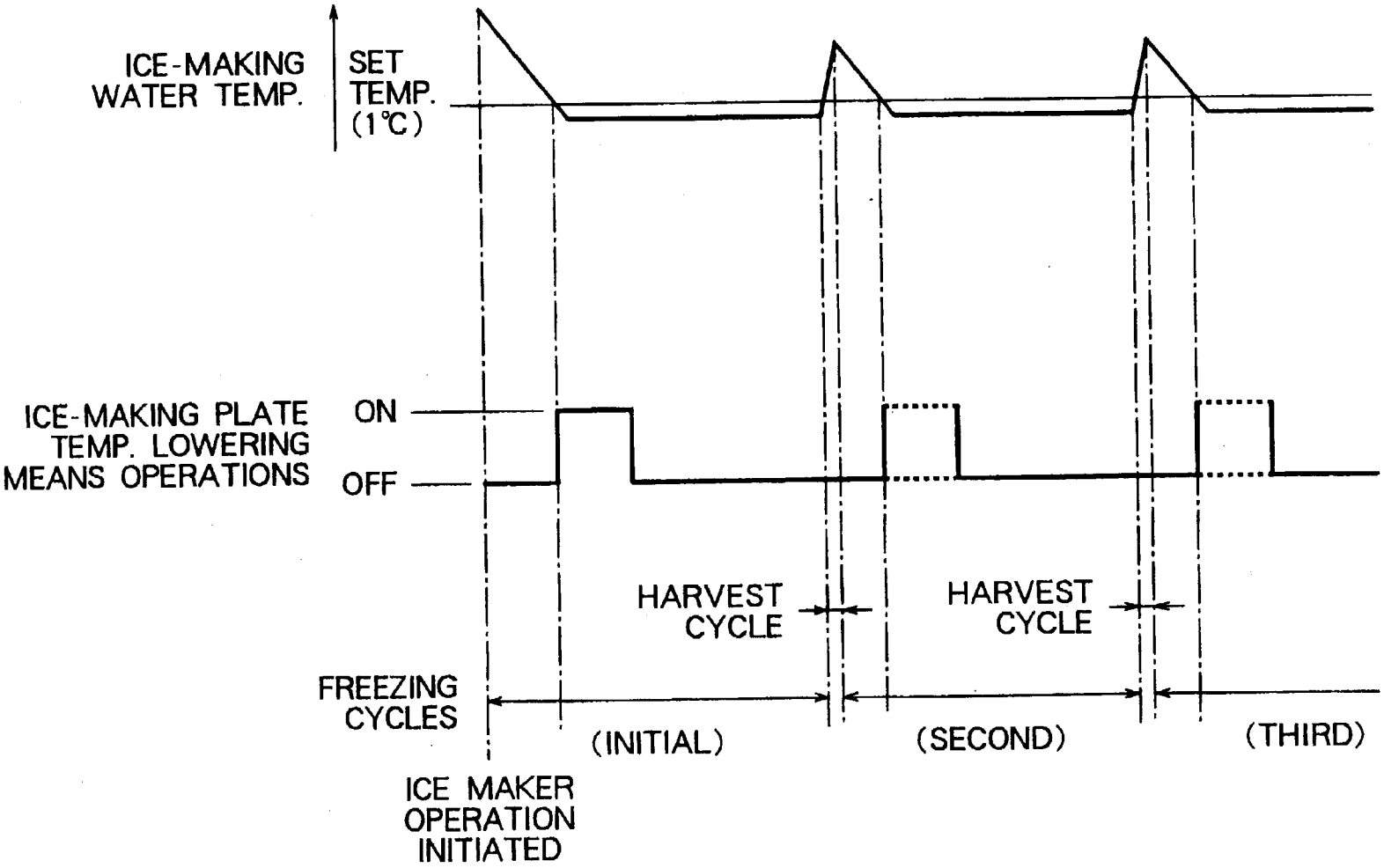
FIG. 4 is a diagram explaining the operation of an ice-making plate temperature lowering means of another embodiment of the present invention.

FIG. 4 shows another embodiment. In the above-mentioned embodiment, operation of the ice-making plate temperature lowering means as the counter measure for partial ice generation was determined, although indirectly, in the freezing cycles including the initial freezing cycle, by comparing the refrigerating capacity at the set temperature and the predetermined capacity. However, compared with the second or subsequent freezing cycles, the probability of generating partial ice in the initial freezing cycle is extremely high since the temperature of the components of the ice maker are high and the refrigerating load for cooling the elements excluding the ice-making water is large so that the refrigerating capacity with respect to the refrigerating load becomes small. Further, since the refrigerating load for cooling the elements excluding the ice-making water varies significantly according to the season or during the day or night, if the predetermined capacity is set taking these factors into consideration, the predictable fluctuation range becomes so large that it lacks accuracy.

The embodiment shown in FIG. 4 was made to cope with this point. That is, in the initial freezing cycle, the ice-making plate temperature lowering means always starts operating whenever the ice-making water temperature reaches 1° C., which is the set temperature, without determining the refrigerating capacity.

In FIG. 4, time is plotted in the horizontal axis, with the upper column showing the change of the ice-making water temperature. The middle column shows the on or off state of the ice-making plate temperature lowering means, and the lower column shows the timing of the freezing cycle and the harvest cycle. As shown in this figure, the ice-making water temperature starts decreasing as the ice-maker starts operating. In the initial freezing cycle, the ice-making plate temperature lowering means starts operating whenever the ice-making water temperature reaches 1° C., which is the set temperature.

However, in the second or subsequent freezing cycles, the high side pressure is detected when the ice-making water temperature becomes 1° C., which is the set temperature, so that the determination is made that the refrigerating capacity is lower than the predetermined capacity when the high side pressure is greater than the standard high side pressure which starts operation of the ice-making plate temperature lowering means, or that the refrigerating capacity is greater than the predetermined capacity when the high side pressure is lower than the standard high side pressure which continues the ice-making operation without operating the ice-making plate temperature lowering means. Since the operation of the ice-making plate temperature lowering means is selectively conducted in the second or subsequent freezing cycles, FIG. 4 shows this condition with a thick doted line.

In the case of this embodiment, since the ice-making plate temperature lowering means starts operating whenever the ice-making water reaches a predetermined temperature in the initial freezing cycle, the generation of partial ice can be reliably prevented in the first freezing cycles. Further, in the second or subsequent freezing cycle, since the predictable fluctuation range of the refrigerating load for cooling the elements excluding the ice-making water is small, the necessity of operating the ice-making plate temperature lowering means can be accurately determined. Therefore, the above mentioned accompanying problems can be restrained further.

Furthermore, the above-mentioned embodiments can be embodied with the below-mentioned modifications.

(1) The set temperature of the ice-making water is not limited to 1° C. but can be optionally set taking into consideration the cooling rate of the ice-making water, the error factor in measuring the temperature of the ice-making water, and the operating time of the counter measure for partial ice generation.

(2) In the ice maker, in general, the larger the refrigerating capacity is with respect to the refrigerating load for making ice, the lower the high side pressures such as the discharged gas pressure of the compressor and the condensing pressure, the low side pressures such as the sucked gas pressure of the compressor and the evaporating pressure, the condensing temperature and the evaporating temperature are; the smaller the refrigerating capacity is with respect to the refrigerating load for making ice, the higher the high side pressures such as the discharged gas pressure of the compressor and the condensing pressure, the low side pressures such as the sucked gas pressure of the compressor and the evaporating pressure, the condensing temperature and the evaporating temperature are. Therefore, by detecting the pressures or the temperatures, the size of the refrigerating capacity with respect to the refrigerating load can be detected. That is, as in the first embodiment, the size. of the refrigerating capacity can be determined by plotting the low side pressure, the condensing temperature or the evaporating temperature, in the vertical axis in place of the high side pressure in FIG. 2, and setting a standard low side pressure, a standard condensing temperature or a standard evaporating temperature in the area where partial ice does not develop, and determining whether or not the detected low side pressure, the condensing temperature or the evaporating temperature is greater than or lower than the standard low side pressure, the standard condensing temperature or the standard evaporating temperature.

In the case of an ice maker having an air cooled condenser, the refrigerating capacity of the ice maker becomes smaller as the surrounding air temperature becomes higher, and becomes higher as the surrounding air temperature is lower. In the case of an ice maker having a water cooled condenser, the refrigerating capacity of the ice maker becomes smaller as the cooling water temperature becomes higher, and becomes higher as the cooling water temperature becomes lower. Therefore, by detecting the surrounding air temperature or the cooling water temperature, the refrigerating capacity can be detected. That is, as in the first embodiment, the size of the refrigerating capacity can be determined by plotting the surrounding air temperature or the cooling water temperature in the vertical axis in place of the high side pressure in FIG. 2, and setting a standard surrounding air temperature or a standard cooling water temperature in the area where partial ice does not developed, and determining whether or not the detected surrounding air temperature or the cooling water temperature is greater than or lower than the standard surrounding air temperature or the standard cooling water temperature.

Figure 3:
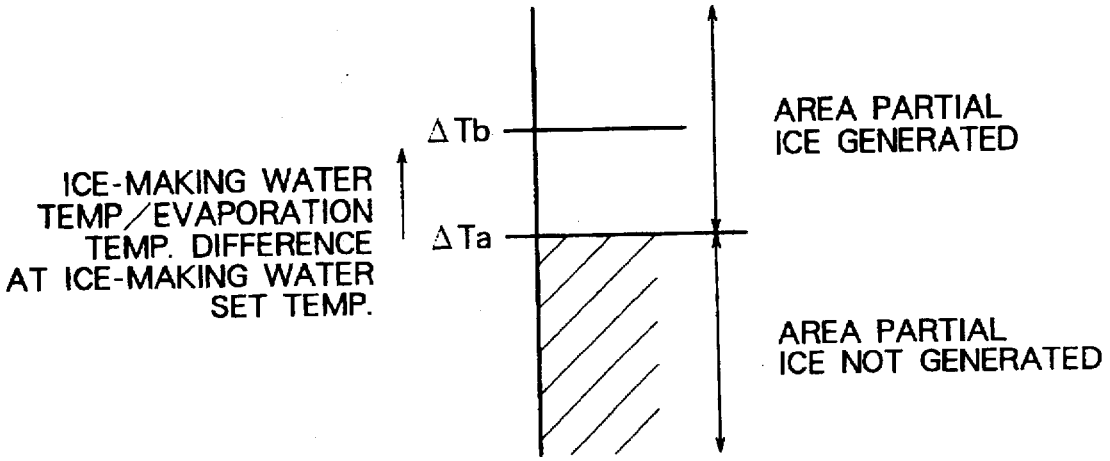
FIG. 3 is a diagram showing the relationship between the temperature difference between the ice-making water temperature and the evaporating temperature, and partial ice generation.

Since the refrigerating capacity can be detected by detecting the evaporating temperature at the set temperature of the ice-making water as mentioned above, the size of the refrigerating capacity can also be detected by detecting the temperature difference between the ice-making water temperature and the evaporating temperature at the set temperature of the ice-making water. That is, FIG. 3 shows that partial ice develops with at the set temperature of the ice-making water a temperature difference less than ΔTa, and partial ice does not generate with a temperature difference greater than ΔTa. Further, a standard temperature difference ΔTb is set in the area where partial ice does not developed. When the detected temperature difference is greater than the standard temperature difference ΔTb, the refrigerating capacity is greater than the predetermined capacity, and when the detected temperature difference is lower than the standard temperature difference ΔTb, the refrigerating capacity is less than the predetermined capacity.

Figure 5:
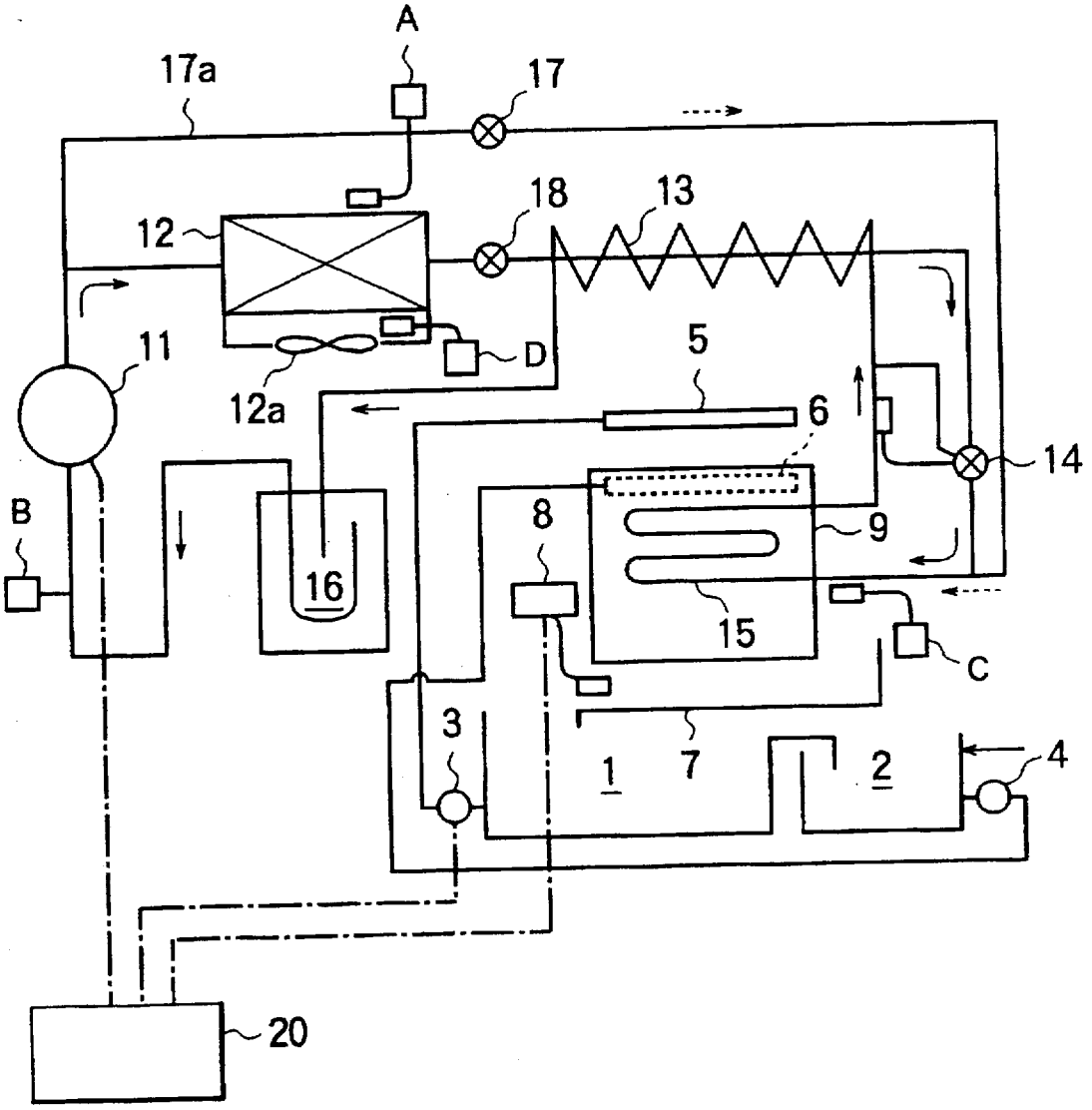
FIG. 5 is a schematic diagram of an ice maker of another embodiment of the present invention.

FIG. 5 concretely shows the detection method and detection positions for the condensing temperature, the low side pressure, the evaporating temperature and the surrounding air temperature in place of the high pressure sensor 21 in FIG. 1. In FIG. 1, A represents a condensing temperature sensor provided in the condenser 12 for detecting the condensing temperature, B represents a low pressure sensor provided in the suction pipe of the compressor 11 for detecting the low side pressure, C represents an evaporating temperature sensor provided in the evaporator 15 for detecting the evaporating temperature, D represents a surrounding air temperature sensor provided at the cooling air inlet side of the condenser 12 for detecting the temperature of the air surrounding the ice maker, which is the cooling medium of the condenser 12. Further when detecting the cooling water temperature, a temperature sensor can be provided in the cooling water pipe (not illustrated) of the condenser 12.

As heretofore mentioned, the refrigerating capacity detection means can be provided by adopting one of the above-mentioned sensors to take the place of the high pressure sensor 21 so that the refrigerating capacity and the predetermined capacity can be comparatively determined as follows.

(A) By detecting the condensing temperature it can be determined that the refrigerating capacity is lower than the predetermined capacity when the detected condensing temperature is greater than the standard condensing temperature, and that the refrigerating capacity is greater than the predetermined capacity when the detected condensing temperature is lower than the standard condensing temperature.

(B) By detecting the low side pressure it can be determined that the refrigerating capacity is lower than the predetermined capacity when the detected low side pressure is greater than the standard low side pressure and that the refrigerating capacity is greater than the predetermined capacity when the detected low side pressure is lower than the standard low side pressure.

(C) By detecting the evaporating temperature it can be determined that the refrigerating capacity is lower than the predetermined capacity when the detected evaporating temperature is greater than the standard evaporating temperature and that the refrigerating capacity is greater than the predetermined capacity when the detected evaporating temperature is lower than the standard evaporating temperature.

(D) By detecting the difference between the ice-making temperature and the evaporating temperature it can be determined that the refrigerating capacity is lower than the predetermined capacity when the detected difference is lower than the standard difference and that the refrigerating capacity is greater the predetermined capacity when the detected difference is greater than the standard difference.

(E) By detecting the refrigerant temperature of the condenser it can be determined that the refrigerating capacity is lower than the predetermined capacity when the detected refrigerant temperature is greater than the standard refrigerant temperature and that the refrigerating capacity is greater than the predetermined capacity when the detected refrigerant temperature is lower than the standard refrigerant temperature.

(3) Regarding the ice-making plate temperature lowering means, the first embodiment is based on reducing the freezing load by stopping the supply of the ice-making water to the ice-making plate 9, but it is also possible to construct the present invention such that the ice-making water supply can be decreased. For example, it is possible to provide a flow control valve in the ice-making water circuit extending from the ice-making water circulation pump 3 to the distributor 5 so that the amount of the ice-making water supplied to the ice-making plate 9 is reduced by controlling the degree the flow control valves opened when the refrigerating capacity at the set temperature of the ice-making water is lower than the predetermined capacity. In the aforementioned embodiment, there is hardly any refrigerating load when the ice-making plate temperature lowering means is operated, and when the ice-making plate temperature lowering means operates for a slightly extended period of time there is a fear that the liquid refrigerant will be sucked in by the compressor 11. With this modified embodiment, however,this fear can be avoided.

Furthermore, flow of the refrigerant from the compressor 11 to the evaporator 15 may be stopped or the amount of it circulating reduced as another example of a modified embodiment of the ice-making plate temperature lowering means based on the temporary decreasing the temperature of the ice-making plate 9. A means for closing the solenoid valve 18 or the expansion valve 14 of the liquid pipe can be provided as the former refrigerant flow stopping means. Further, a means for forcibly reducing the degree the expansion valve 14 is opened, can, for example, be provided as the latter refrigerant circulation amount reducing means.

The present invention can be embodied in other forms without departing from the spirit or essential characteristics thereof. Therefore, the embodiments heretofore explained are illustrative and thus the present invention is not limited thereto. Modifications or alterations within the range of the following claims are also within the scope of the present invention.

What is claimed is:

1. A water-circulating type ice maker comprising a refrigerating circuit having an ice-making water circuit where ice-making water is circulated and supplied to an ice-making plate by a circulation pump, an evaporator provided at the ice-making plate for freezing the circulating water on the ice-making plate, and a condenser which is cooled by the air surrounding the ice maker or a cooling medium such as cooling water, wherein a refrigerating capacity detecting means for detecting the refrigerating capacity of the ice maker at a set temperature, which is slightly above the temperature where the ice-making water starts to freeze in a state of partial ice, and an ice-making plate temperature lowering means for lowering the temperature of the ice-making plate as a counter measure against partial ice generation are provided so that the ice-making plate temperature lowering means starts operating when the refrigerating capacity detected by the refrigerating capacity detecting means is lower than a predetermined capacity.

2. The water-circulating type ice maker according to claim 1, wherein the refrigerating capacity detecting means detects the high side pressure and determines that the refrigerating capacity is lower than the predetermined capacity when the high side pressure is greater than the standard high side pressure, and that the refrigerating capacity is greater than the predetermined capacity when the high side pressure is lower than the standard high side pressure.

3. The water-circulating type ice maker according to claim 1, wherein the refrigerating capacity detecting means detects the condensing temperature and determines that the refrigerating capacity is lower than the predetermined capacity when the condensing temperature is greater than the standard condensing temperature, and that the freezing capacity is greater than the predetermined capacity when the condensing temperature is lower than the standard condensing temperature.

4. The water-circulating type ice maker according to claim 1, wherein the refrigerating capacity detecting means detects the low side pressure and determines that the refrigerating capacity is lower than the predetermined capacity when the low side pressure is greater than the standard low side pressure, and that the refrigerating capacity is greater than the predetermined capacity when the low side pressure is lower than the standard low side pressure.

5. The water-circulating type ice maker according to claim 1, wherein the refrigerating capacity detecting means detects the evaporating temperature and determines that the refrigerating capacity is lower than the predetermined capacity when the evaporating temperature is greater than the standard evaporating temperature, and that the refrigerating capacity is greater than the predetermined capacity when the evaporating temperature is lower than the standard evaporating temperature.

6. The water-circulating type ice maker according to claim 1, wherein the refrigerating capacity detecting means detects the temperature difference between the ice-making water temperature and the evaporating temperature and determines that the refrigerating capacity is lower than the predetermined capacity when the temperature difference is lower than the standard temperature difference, and that the refrigerating capacity is greater than the predetermined capacity when the temperature difference is greater than the standard temperature difference.

7. The water-circulating type ice maker according to claim 1, wherein the refrigerating capacity detecting means detects the refrigerant temperature of the condenser and determines that the refrigerating capacity is lower than the predetermined capacity when the cooling medium temperature is greater than the standard cooling medium temperature, and that the refrigerating capacity is greater than the predetermined capacity when the refrigerant temperature is lower than the standard refrigerant temperature.

8. A water-circulating type ice maker comprising a refrigerating circuit having an ice-making water circuit where ice-making water is circulated and supplied to an ice-making plate by a circulation pump, an evaporator provided at the ice-making plate for freezing the circulating water on the ice-making plate, and a condenser which is cooled by the air surrounding the ice maker or a cooling medium such as cooling water, wherein a refrigerating capacity detecting means for detecting the refrigerating capacity of the ice maker at a set temperature, which is slightly above the temperature where the ice-making water starts to freeze in a state of partial ice, and an ice-making plate temperature lowering means for lowering the temperature of the ice-making plate as a counter measure for partial ice generation are provided so that the ice-making plate temperature lowering means starts operating whenever the ice-making water temperature reaches the set temperature in the initial freezing cycle after starting the operation of the ice maker, and the ice-making plate temperature lowering means starts operating when the refrigerating capacity detected by the refrigerating capacity detecting means is lower than a predetermined capacity in the second or subsequent freezing cycles.

9. The water-circulating type ice maker according to claim 8, wherein the refrigerating capacity detecting means detects the high side pressure and determines that the refrigerating capacity is lower than the predetermined capacity when the high side pressure is greater than the standard high side pressure, and that the refrigerating capacity is greater than the predetermined capacity when the high side pressure is lower than the standard high side pressure.

10. The water-circulating type ice maker according to claim 8, wherein the refrigerating capacity detecting means detects the condensing temperature and determines that the refrigerating capacity is lower than the predetermined capacity when the condensing temperature is greater than the standard condensing temperature, and that the freezing capacity is greater than the predetermined capacity when the condensing temperature is lower than the standard condensing temperature.

11. The water-circulating type ice maker according to claim 8, wherein the refrigerating capacity detecting means detects the low side pressure and determines that the refrigerating capacity is lower than the predetermined capacity when the low side pressure is greater than the standard low side pressure, and that the refrigerating capacity is greater than the predetermined capacity when the low side pressure is lower than the standard low side pressure.

12. The water-circulating type ice maker according to claim 8, wherein the refrigerating capacity detecting means detects the evaporating temperature and determines that the refrigerating capacity is lower than the predetermined capacity when the evaporating temperature is greater than the standard evaporating temperature, and that the refrigerating capacity is greater than the predetermined capacity when the evaporating temperature is lower than the standard evaporating temperature.

13. The water-circulating type ice maker according to claim 8, wherein the refrigerating capacity detecting means detects the temperature difference between the ice-making water temperature and the evaporating temperature and determines that the refrigerating capacity is lower than the predetermined capacity when the temperature difference is lower than the standard temperature difference, and that the refrigerating capacity is greater than the predetermined capacity when the temperature difference is greater than the standard temperature difference.

14. The water-circulating type ice maker according to claim 8, wherein the refrigerating capacity detecting means detects the refrigerant temperature of the condenser and determines that the refrigerating capacity is lower than the predetermined capacity when the cooling medium temperature is greater than the standard cooling medium temperature, and that the refrigerating capacity is greater than the predetermined capacity when the refrigerant temperature is lower than the standard refrigerant temperature.

* * * * *